US008988304B2

(12) United States Patent
Alexander

(10) Patent No.: US 8,988,304 B2
(45) Date of Patent: Mar. 24, 2015

(54) SYSTEMS AND METHODS FOR INJECTION MOLDED PHASE SHIFTER

(71) Applicant: Honeywell International Inc., Morristown, NJ (US)

(72) Inventor: Jeffrey Alexander, Atlanta, GA (US)

(73) Assignee: Honeywell International Inc., Morristown, NJ (US)

( * ) Notice: Subject to any disclaimer, the term of this patent is extended or adjusted under 35 U.S.C. 154(b) by 217 days.

(21) Appl. No.: 13/651,079

(22) Filed: Oct. 12, 2012

(65) Prior Publication Data

US 2014/0104130 A1 Apr. 17, 2014

(51) Int. Cl.

| | |
|---|---|
| ***H01Q 21/00*** | (2006.01) |
| ***H01P 1/195*** | (2006.01) |
| ***H01P 1/19*** | (2006.01) |

(52) U.S. Cl.

CPC . *H01P 1/19* (2013.01); *H01P 1/195* (2013.01)
USPC ..... 343/853; 333/158

(58) Field of Classification Search

CPC ..... B32B 37/0023; H01P 1/19; H01P 1/195; H01Q 3/36
USPC ..... 343/853; 342/375; 333/158, 161; 29/527.1

See application file for complete search history.

(56) References Cited

U.S. PATENT DOCUMENTS

| | | | |
|---|---|---|---|
| 3,408,597 | A | 10/1968 | Heiter |
| 3,761,845 | A | 9/1973 | Ajoika et al. |
| 3,811,099 | A | 5/1974 | Mason et al. |
| 3,849,746 | A | 11/1974 | Mason et al. |
| 3,952,267 | A | 4/1976 | Dischert |
| 4,445,098 | A | 4/1984 | Sharon et al. |
| 4,458,218 | A | 7/1984 | Babbitt et al. |
| 4,887,054 | A | 12/1989 | Stern et al. |

(Continued)

FOREIGN PATENT DOCUMENTS

| | | |
|---|---|---|
| EP | 1689029 | 8/2006 |
| FR | 2829620 | 3/2003 |
| JP | S562701 | 1/1981 |

OTHER PUBLICATIONS

European Patent Office, "European Search Report from EP Application No. 13185638.7 mailed Jan. 27, 2014", "from Foreign Counterpart of U.S. Appl. No. 13/651,079", Jan. 27, 2014, Published in: EP.

(Continued)

*Primary Examiner* — Hoanganh Le
(74) *Attorney, Agent, or Firm* — Fogg & Powers LLC

(57) ABSTRACT

Systems and methods for an injection molded phase shifter are provided. In at least one embodiment, a method for fabricating a phase shifter comprises fabricating a ferrite element with first and second ends, wherein electromagnetic energy propagating through the ferrite element propagates between the first the second end; placing the ferrite element within a waveguide mold; and injecting a liquefied dielectric into the mold, wherein the liquefied dielectric hardens to form first and second solid dielectric layers that abut against out-of-plane surfaces of the ferrite element. The method further comprises exposing in-plane surfaces of the ferrite element, wherein the in-plane surfaces extend longitudinally between the first and the second end and are orthogonal to the out-of-plane surfaces that extend longitudinally between the first and the second end; masking surfaces through which electromagnetic energy is emitted into and transmitted from the phase shifter; and plating the exposed surfaces.

19 Claims, 5 Drawing Sheets

(56) References Cited

U.S. PATENT DOCUMENTS

| | | | | | |
|---|---|---|---|---|---|
| 5,075,648 | A | * | 12/1991 | Roberts et al. | 333/128 |
| 5,724,011 | A | * | 3/1998 | McWhirter et al. | 333/157 |
| 5,828,271 | A | * | 10/1998 | Stitzer | 333/24.1 |
| 5,876,539 | A | | 3/1999 | Bailey et al. | |
| 7,417,587 | B2 | | 8/2008 | Iskander et al. | |

OTHER PUBLICATIONS

Bornemann et al., "Modal-S-Matrix Desigm of Optimum Stepped Ridged and Finned Waveguide Transformers", "IEEE Transactions on Microwave Theory and Techniques", Jun. 1987, pp. 561-567, vol. MTT-35, No. 6, Publisher: IEEE.

Charlton, "A Low-Cost Construction Technique for Garnet and Lithium-Ferrite Phase Shifters", "IEEE Transactions on Microwave Theory and Techniques", Jun. 1974, pp. 614-617, vol. MTT-22, No. 6.

Stark et al., "Microwave Components for Wide-Band Phased Arrays", "Proceedings of the IEEE", Nov. 1968, pp. 1908-1923, vol. 56, No. 11, Publisher: IEEE.

European Patent Office, "Office Action from EP Application No. 13185638.7 mailed Feb. 7, 2014", "from Foreign Counterpart of U.S. Appl. No. 13/651,079", Feb. 7, 2014, pp. 1-11, Published in: EP.

Pozar, "10.5 Ferrite Phase Shifters", Feb. 2004, pp. 1-4.

* cited by examiner

SYSTEMS AND METHODS FOR INJECTION MOLDED PHASE SHIFTER

BACKGROUND

Phased antenna arrays use multiple phase shifting elements when receiving and emitting electromagnetic energy. The different phase shifting elements shift the phase of signals passing through the phase shifting elements by different magnitudes to form and steer at least one antenna beam of the phased antenna array. In certain implementations, to provide adequate gain, the antenna arrays can include thousands of phase shifting elements to adequately steer the beam over a desired frequency range. The amount of power travelling through the many phase shifting elements can cause thermal management issues. To thermally manage the system, passive elements like ferrite phase shifters can be used because ferrite phase shifters offer a low insertion loss and low design complexity. Also, waveguide non-reciprocal ferrite phase shifters offer a lower complexity and lower insertion loss than other ferrite phase shifter types. However, ferrite phase shifters mounted within housings designed to fit within a phased array are fabricated according to tight tolerances which make the ferrite phase shifters expensive to fabricate. Also, Broadband ferrite phase shifters are mounted within housings that are too large for the spacing of elements in a phased antenna array

SUMMARY

Systems and methods for an injection molded phase shifter are provided. In at least one embodiment, a method for fabricating a phase shifter comprises fabricating a ferrite element with a first end and a second end, wherein electromagnetic energy propagating through the ferrite element propagates between the first end and the second end; placing the ferrite element within a waveguide mold; and injecting a liquefied dielectric into the waveguide mold, wherein the liquefied dielectric hardens to form a first solid dielectric layer and a second solid dielectric layer that abut against out-of-plane surfaces of the ferrite element, wherein the first solid dielectric layer and the second solid dielectric layer have a first dielectric end that corresponds to the first end and a second dielectric end that corresponds to the second end. The method further comprises exposing in-plane surfaces of the ferrite element, wherein the in-plane surfaces extend longitudinally between the first end and the second end and are orthogonal to the out-of-plane surfaces that extend longitudinally between the first end and the second end; masking surfaces through which electromagnetic energy is emitted into and transmitted from the phase shifter; and plating the exposed surfaces of the phase shifter.

DRAWINGS

Understanding that the drawings depict only exemplary embodiments and are not therefore to be considered limiting in scope, the exemplary embodiments will be described with additional specificity and detail through the use of the accompanying drawings, in which.

Figure 1:
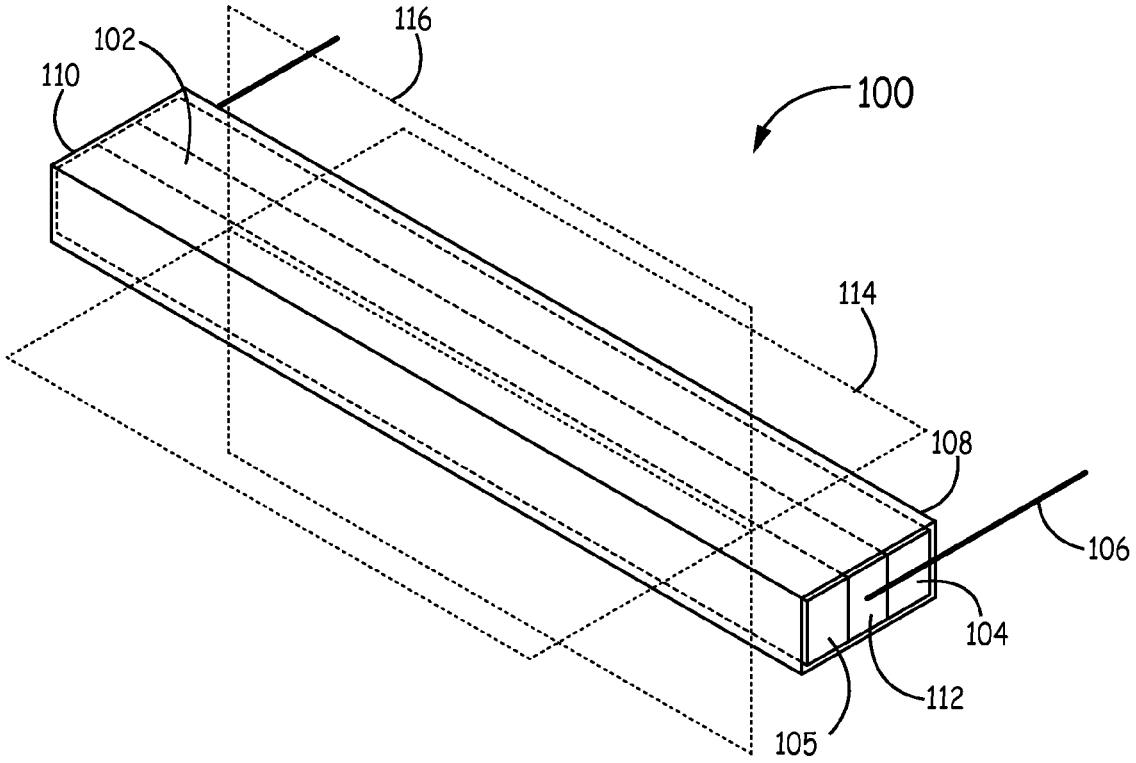
FIG. 1 is a drawing illustrating a phase shifting segment in one embodiment described in the present disclosure.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to e taken in a limiting sense.

Embodiments of the present invention address the problems posed by the size and expense of phase shifters using ferrite elements. As disclosed herein, phase shifters containing ferrite elements can be fabricated using an injection molding process that results in a ferrite element that is both smaller and less expensive to fabricate. For example, a ferrite element is placed within a mold, the mold is injected with a dielectric and when the dielectric is sufficiently hardened, the mold is removed. The ferrite element and the dielectric are then shaped to expose surfaces of the ferrite element and the ferrite element and dielectric are coated in a metal layer, which metal layer forms a waveguide enclosure, where the waveguide enclosure is in contact with the exposed surfaces of the ferrite element.

FIG. 1 is a diagram of a phase shifter segment 100 having an enclosed ferrite element 102 according to one embodiment of the present invention. Phase shifter segment 100 includes RF or waveguide enclosure 108 that encloses the ferrite element 102, which is layered between a first solid dielectric layer 104 and a second solid dielectric layer 105. In certain implementations, phase shifter segment 100 is an RF component that shifts the phase of a signal within a particular frequency range. Also, as used herein, the ferrite element 102 is composed of ferrite which is a non-reciprocal material where the relationship between an oscillating current and the resulting electric fields changes if the location where the current is placed and where the field is measured changes. Further, electromagnetic energy within the waveguide enclosure 108 propagates within the ferrite element 102. For example, the ferrite element 102 within the waveguide enclosure 108 allows signals in the range of 6.5-18 GHz to propagate within the ferrite element 102. To control the frequency response of the ferrite element 102, the cross sectional size of the ferrite element 102 is selected accordingly. Also, the ferrite material used to fabricate the ferrite element 102 can be selected based on its magnetization characteristics to achieve a desired frequency response.

As electromagnetic energy propagates through the waveguide enclosure 108, the electromagnetic energy propagates longitudinally through the ferrite element 102 between a first end 110 and a second end 112 of the ferrite element 102. During the propagation, magnetic fields aligned with an H-plane 114 and electric fields aligned with an E-plane 116 propagate within the ferrite element 102 within the waveguide enclosure 108. The H-plane 114 and the E-plane 116 are orthogonal to one another. Further, the H-plane 114 is aligned with the longitudinal direction of propagation within the waveguide enclosure 108. As described below, the surfaces of the components within the phase shifter segment 100 are referred to as in-plane surfaces or out-of-plane surfaces. An in-plane surface is a surface of a component that is parallel to the H-plane 114. An out-of-plane surface is a surface of a component that is perpendicular to the H-plane 114 but aligned with the direction of propagation As stated earlier, the ferrite element 102 is layered between a first solid dielectric layer 104 and a second solid dielectric layer 105. The first solid dielectric layer 104 and the second solid dielectric layer 105 are formed against surfaces of the ferrite element 102 in a manner that inhibits the formation of air gaps between the first solid dielectric layer 104 and the second solid dielectric layer 105. In certain implementations, the ferrite element 102 has a rectangular (e.g., square) cross-section and consists of four surfaces that extend longitudinally between the first end 110 and the second end 112 of the ferrite element 102. The four surfaces include two in-plane surfaces that are opposite one another and two out-of-plane surfaces that are opposite one another and orthogonal to the in-plane surfaces. The in-plane surfaces of the ferrite element 102 are the two surfaces that abut against the inner surface of the waveguide enclosure 108 and the out-of-plane surfaces are the two surfaces that abut against the first solid dielectric layer 104 and the second solid dielectric layer 105. Accordingly, the first solid dielectric layer 104 and the second solid dielectric layer 105 abut against the out-of-plane surfaces of the ferrite element 102, where the in-plane surfaces of the ferrite element 102 are in contact with an inner surface of the waveguide enclosure 108. The first solid dielectric layer 104 and the second solid dielectric layer 105 are layers of solid dielectric that allow a greater bandwidth of signals to propagate within the ferrite element 102. Further, because the out-of-plane surfaces of the ferrite element 102 are bounded by material having a larger dielectric constant than air, the cross-sectional size of the phase shifter segment 100 can be smaller. For example, in certain implementations, the first solid dielectric layer 104 and the second solid dielectric layer 105 are formed from a solid material having a dielectric constant of 4 as opposed to the dielectric constant of air.

As described herein, the surfaces of the first solid dielectric layer 104 and the second solid dielectric layer 105 that are not in contact with the out-of-plane surfaces of the ferrite element 102 are in contact with the inner surface of the waveguide enclosure 108. The waveguide enclosure is formed around the first solid dielectric layer 104, the second solid dielectric layer 105, and the ferrite element 102 such that there are no air gaps between the inner surface of the waveguide enclosure and the first solid dielectric layer 104, the second solid dielectric layer 105, and the ferrite element 102. The waveguide enclosure 108 is formed around the first solid dielectric layer 104, the second solid dielectric layer 105, and the ferrite element 102 without air gaps to prevent the propagation and/or formation of signals having non-desired modes within the waveguide enclosure 108. Further, the waveguide enclosure 108 is a continuous layer of metal that encapsulates the combination of the ferrite element 102, the first solid dielectric layer 104, and the second solid dielectric layer 105.

In at least one embodiment, the ferrite element 102 includes a magnetizing winding 106 that extends from a first end 110 of the phase shifter segment 100 to a second end 112 of the phase shifter segment. The magnetizing winding 106 can be used to change the phase of a signal propagating through the ferrite element 102 by adjusting a current sent through the magnetizing winding to adjust the magnetization of the ferrite element 102. When an electrical pulse or electrical signal is conducted through the magnetizing winding 106, the current passing through the magnetizing winding 106 creates electric and magnetic fields within the waveguide enclosure 108. The strength of the electrical signal conducting through the magnetizing winding 106, determines the magnetic field of the ferrite element 102. In certain implementations, when only an electrical pulse or other electrical signal of short duration is conducted through the magnetizing winding, the ferrite element 102 is latched to a particular magnetization value. For example, an electrical pulse through the magnetizing winding 106 can produce a magnetization value that saturates the magnetization of the ferrite element 102. When the electrical pulse subsides, the ferrite element 102 remains magnetized at a remnant magnetization value. Values of magnetization lower than full remnance can be achieved by applying an electrical pulse of lower value, the remance can be controled from zero to full remnance by adjusting the value of the electrical pulse. Alternatively, a continuous electrical signal is passed through the ferrite element 102 where the magnetic field produced by the electrical signal determines the magnetization value of the ferrite element 102. In a further alternative implementation, when there is no magnetizing winding, the ferrite element 102 is magnetized by an external magnetic field.

In certain embodiments, when the ferrite element 102 is magnetized by a current or pulse conducted through the magnetizing winding 106, or an external magnetic field, the ferrite element 102 will shift the phase of electromagnetic waves propagating through the ferrite element 102. For example, a magnetized ferrite element 102 shifts the phase of electromagnetic signals as they propagate through the ferrite element 102 between the first end 110 and the second end 112 of the ferrite element 102. The amount that the ferrite element 102 is magnetized in conjunction with the length of the ferrite element 102 determines the amount of phase shift for the electromagnetic signals propagating within the ferrite element 102.

As described above, the phase shifter segment 100 is formed such that there are no air gaps between the ferrite element 102, the first solid dielectric layer 104, the second solid dielectric layer 105, and the waveguide enclosure 108. To form the components of the phase shifter segment 100 without the air gaps while limiting the cost of the phase shifter segment 100, the phase shifter segment 100 is formed using an injection molded process.

Figure 2:
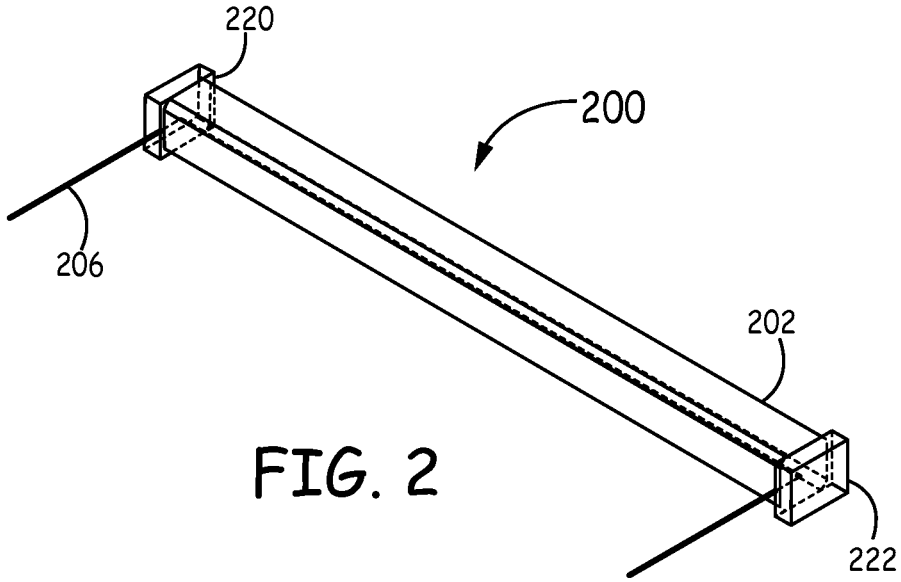
FIGS. 2-5 are drawings illustrating the fabrication of a broadband phase shifter in one embodiment described in the present disclosure.

FIGS. 2-5 illustrate different steps in the fabrication process for constructing a phase shifter 200 that includes a phase shifter segment as described above in regards to phase shifter segment 100. FIG. 2 illustrates the construction of the ferrite element 202 within the phase shifter 200 that, in certain embodiments, functions as ferrite element 102 in FIG. 1. As shown, a magnetizing winding 206 extends through the middle of the ferrite element 202, where the magnetizing winding 206 functions as a magnetizing winding 106 in at least one implementation. The magnetizing winding 206 enters into the ferrite element 202 and longitudinally extends through the length of the ferrite element 202. Further, the magnetizing winding 206 is arranged within the ferrite element 202 in such a way that the length of the magnetizing winding 206 is parallel with the H-plane 114. By being arranged in parallel with the H-plane 114, the magnetizing winding 206 does not interact with electromagnetic energy that propagates through the ferrite element 202. In certain embodiments, the ferrite element 202 is a rectangle with a core, where the magnetizing winding 206 extends through the core within the ferrite element 202.

In a further implementation, a first mode suppressor 220 and a second mode suppressor 222 can be placed at opposite ends of the ferrite element 202. The first mode suppressor 220 and the second mode suppressor 222 are dielectric sections that prevent the development of higher order modes within the ferrite element 202. For example, the first mode suppressor 220 and the second mode suppressor 222 include portions of dielectric film that absorb RF energy that propagates at higher order modes within the ferrite element 202. In an alternative implementation, the shape of the ferrite element 202 can be altered to prevent the propagation of higher order modes such that the first mode suppressor 220 and the second mode suppressor 222 are not necessary.

Figure 3:
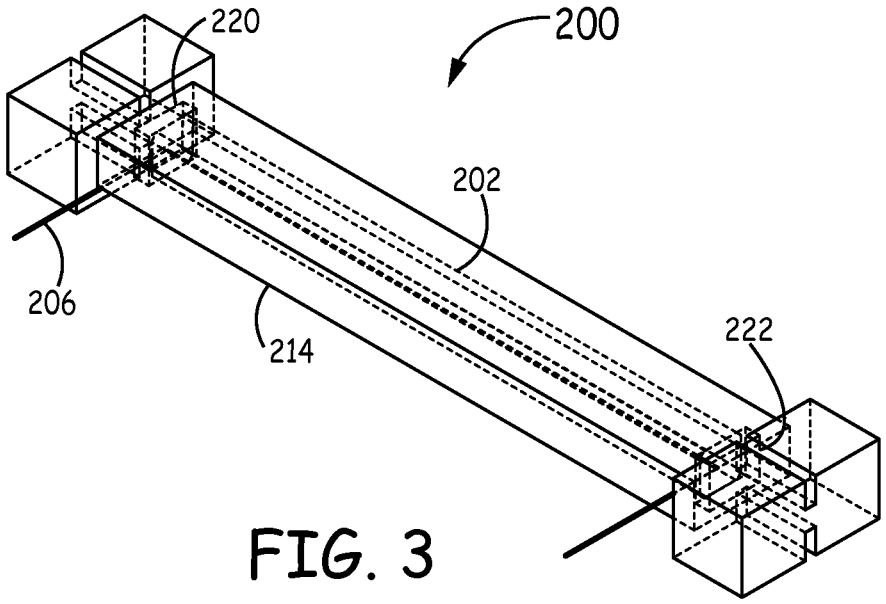

FIG. 3 illustrates a further step in the fabrication of the phase shifter 200 where the ferrite element 202, first and second mode suppressors 220 and 222, and portions of the magnetizing winding 206 are placed into a mold 214. In at least one implementation the magnetizing winding 206 extends out the side of the mold such that the magnetizing winding 206 is able to connect to a current source for magnetizing the ferrite element 202 during operation of the phase shifter 200. In certain implementations, the mold 214 also includes sections for forming a coupling section to another waveguide like a double ridge waveguide. Alternatively, the mold 214 forms a coupling section that connects to other types of waveguides. When the ferrite element 202, and mode suppressors 220 and 222 are appropriately placed within the mold 214, the mold 214 is injected with a liquefied dielectric material. When the dielectric material has cured or hardened, the mold 214 is removed. In at least one embodiment, the coupling sections are separately added to the phase shifter 200 after the formation of the dielectric.

Figure 4:
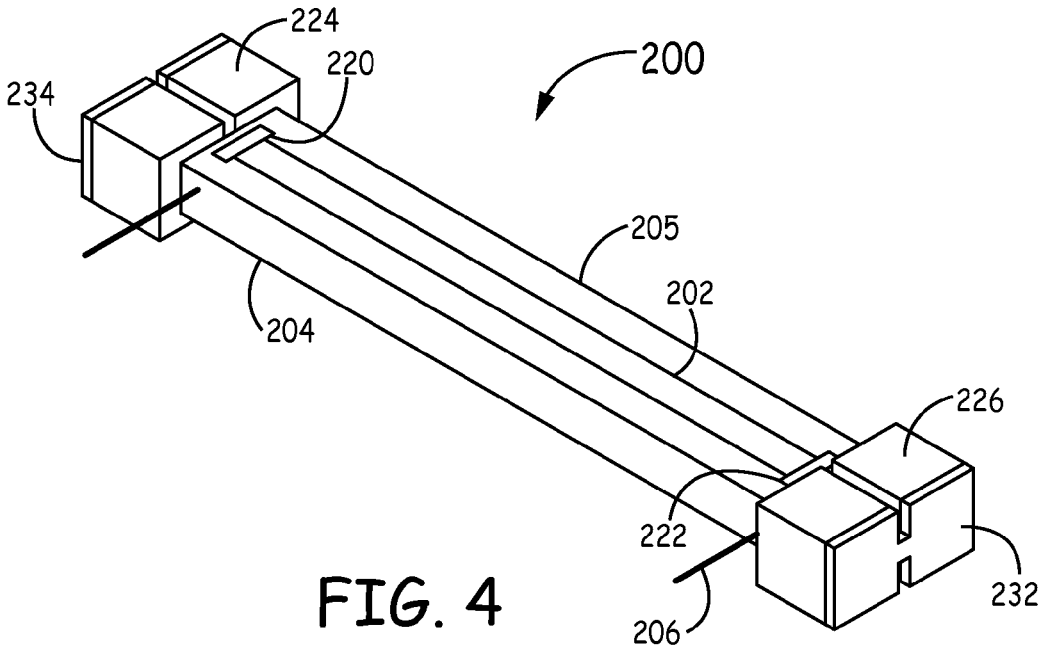

FIG. 4 illustrates a step in the fabrication of the phase shifter 200 where the phase shifter 200 is prepared for metallic plating. After the mold 214 has been injected with a dielectric and the mold has been removed, the dielectric is cut to expose the in-plane surfaces of the ferrite element 202 and the mode suppressors 220 and 222. When the phase shifter 200 is cut (for example, using a fly cut or the like) and the ferrite element 202 is exposed, the out-of-plane surfaces of the ferrite element 202 are in contact with a first solid dielectric layer 204 and a second solid dielectric layer 205. In certain implementations, the first solid dielectric layer 204 and the second solid dielectric layer 205 function as the first solid dielectric layer 104 and the second solid dielectric layer 105 in FIG. 1. In certain implementations, during fabrication, the distance between in-plane surfaces of the ferrite element 202 is larger than desired before the phase shifter is cut. Because the distance is larger, the extra ferrite material can be removed to ensure that all the dielectric material is removed from the in-plane surfaces of the ferrite element 202.

In certain implementations, the phase shifter 200 includes a first coupling section 224 and a second coupling section 226, where the first coupling section 224 and the second coupling section 226 allow the phase shifter 200 to connect to other waveguide elements. For example, the first coupling section 224 and the second coupling section 226 allow the phase shifter 200 to connect to double ridge waveguides, rectangular waveguides, circular waveguides, and the like. coupling sections 224 and 226 further include coupling faces that are masked by masks 232 and 234 during the metallic plating. A coupling face is the face of a coupling section that is orthogonal to the direction of propagation for electromagnetic energy either away or towards the phase shifter. The coupling faces are masked by masks 232 and 234 to prevent the metallic plating from interfering with the propagation of electromagnetic waves either away or towards the phase shifter 200. Because the ferrite element 202 is exposed before metal plating, the metal plating bonds to the ferrite element 202 in such a way that there are no air gaps between the metal plating and the ferrite element 202. The lack of air gaps between the metal plating and the ferrite element 202 inhibits the propagation of higher order modes through the phase shifter 202 and also aids in obtaining consistent impedance matching thus not requiring external tuning elements to counteract inconsistent air gap effects.

Figure 5:
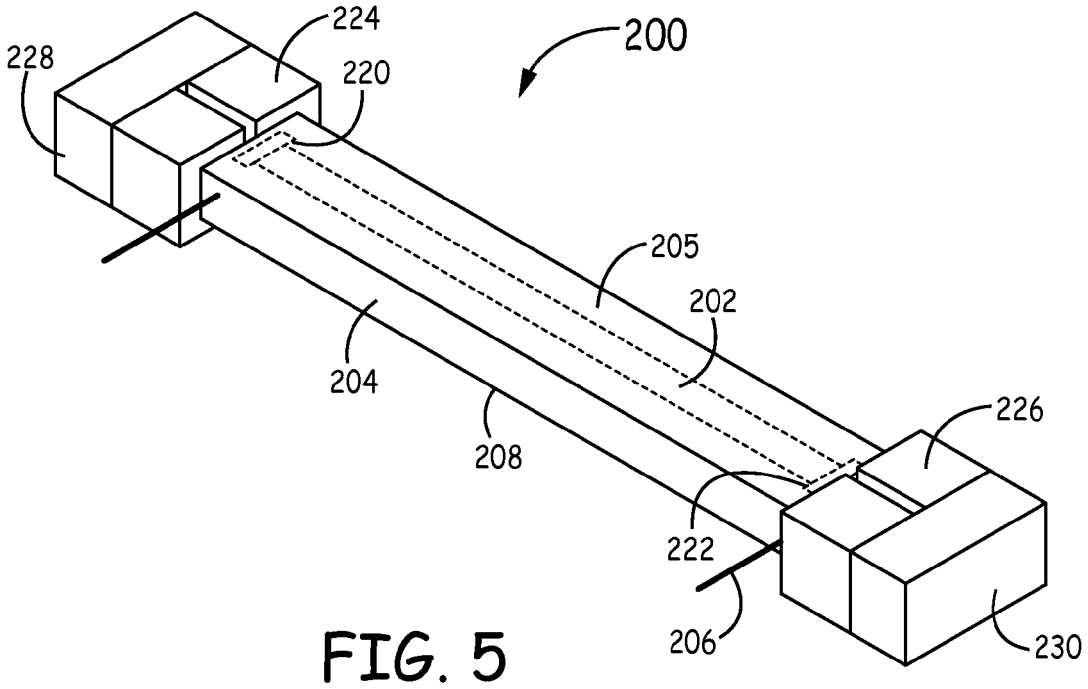

When the phase shifter 200 is metal plated, the masks 232 and 234 are removed and, as shown in FIG. 5, the phase shifter 200 can be coupled to other waveguide elements such as radiating elements 228 and 230. For example, radiating elements 228 and 230 may be double ridge waveguides,a waveguide, or the like. When the phase shifter 200 is metal plated, the metal plating functions as a waveguide enclosure 208 for the phase shifter 200 that, in certain embodiments, functions as waveguide enclosure 108 in FIG. 1. In at least one implementation, the waveguide enclosure 208 encloses propagating electromagnetic energy that propagates between waveguide element 228 and waveguide element 230, which waveguide elements 228 and 230 are coupled to coupling sections 224 and 226. When the phase shifter 200 is fabricated using an injection molding process similar to the process described above, phase shifters 200 can be produced in batch processes at a reduced cost.

Figure 6:
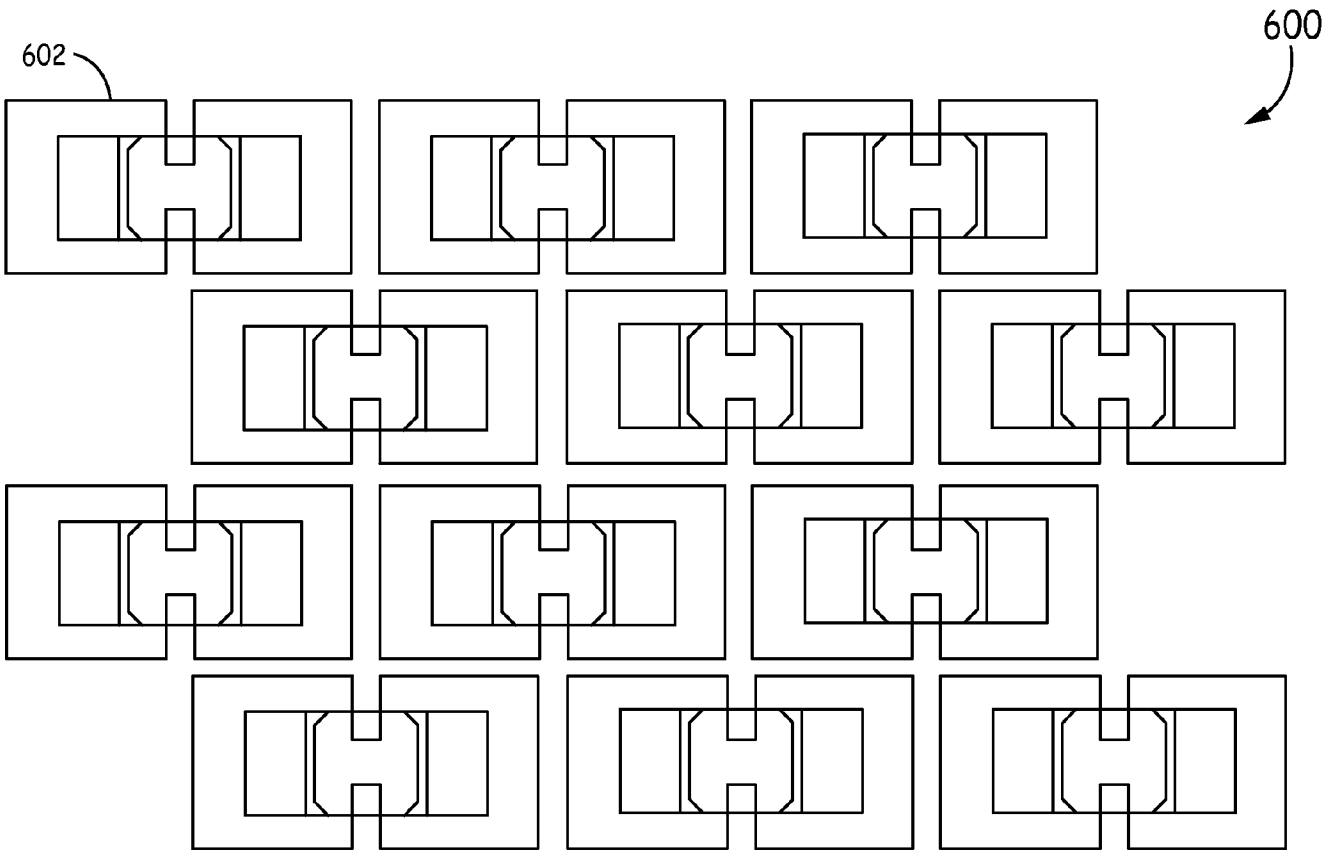
FIG. 6 is a drawing illustrating the placement of the broadband phase shifter within an antenna array in one embodiment described in the present disclosure.

FIG. 6 is a diagram illustrating multiple phase shifters 602 arranged together in a broadband phased antenna array 600. For example, the multiple phase shifters 602 can employ radiating elements (228 and 230) on both ends and be part of a space fed antenna array. In at least one embodiment, the phase shifts of the multiple phase shifters 602 are adjusted to steer at least one antenna beam. Because the ferrite elements within the phase shifters 602 are bordered by material that has a dielectric constant that is greater than the dielectric constant of air, the phase shifters 602 can be placed substantially close enough together to satisfy the requirements for antenna element spacing at higher frequency ranges. For example, in one embodiment, the material bordering the phase shifters can have a dielectric constant of around 4, and the multiple phase shifters 602 are substantially small so that they can be placed next to one another to create a phased antenna array 600 for steering antenna beams in the 6.5-18 GHz frequency range. Different dielectrics and ferrite elements can be used to provide a phase shifter that functions in other desired frequency ranges.

Figure 7:
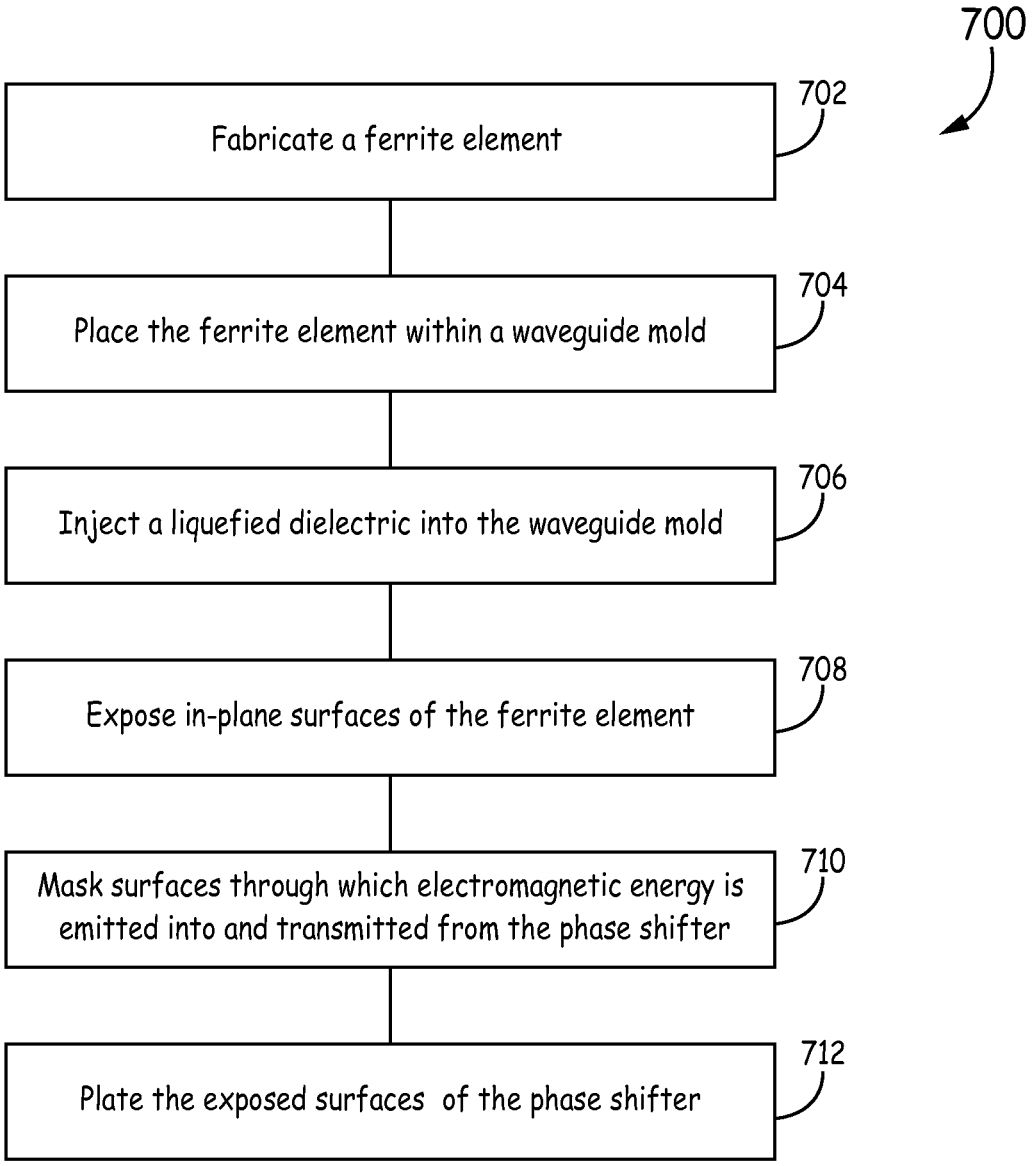
FIG. 7 is a flow diagram illustrating a method for fabricating the phase shifter in one embodiment described in the present disclosure.

FIG. 7 is a flow diagram of an exemplary method 700 for fabricating the phase shifter as described above. Method 700 proceeds at 702, where a ferrite element is fabricated. As described in relation to FIG. 2, a magnetizing winding can be extended through different ends of a ferrite element. Further, mode suppressors can be coupled to opposite ends of the ferrite element to prevent the formation of higher modes in the ferrite element during operation.

Method 700 proceeds at 704 where the ferrite element is placed within a waveguide mold. As described in FIG. 3, mode suppressors are connected to the ferrite element and the ferrite element and mode suppressors are placed within the waveguide mold. Method 700 then proceeds at 706 where, a liquefied dielectric is injected into the waveguide mold. For example, the liquefied dielectric is injected into the waveguide mold. As the liquefied dielectric hardens, the liquefied dielectric forms a first solid dielectric layer and a second solid dielectric layer that abut against out-of-plane surfaces of the ferrite element.

When the dielectric has been injected into the waveguide mold, the waveguide mold is removed and method 700 proceeds to 708, where in-plane surfaces of the ferrite element are exposed. For example, the in-plane surfaces of the phase shifter are cut to remove dielectric material that has formed on the in-plane surfaces of the phase shifter during the injection molding process. When the in-plane surfaces of the ferrite element are exposed, method 700 proceeds at 710, where surfaces through which electromagnetic energy is emitted into and transmitted from the phase shifter are masked. When the surfaces through which electromagnetic energy is emitted into and transmitted from the phase shifter is masked, method 700 proceeds at 712, where the exposed surfaces of the phase shifter are plated. As illustrated in FIG. 5, each end of the phase shifter can be coupled to a coupling section, which coupling section connects to waveguide elements for transporting electromagnetic energy to and from the phase shifter. To enclose the electromagnetic energy within the phase shifter, the phase shifter is plated with a metallic plating to form a waveguide enclosure around the phase shifter. The masks can be removed, and the phase shifter can be integrated into a system such as a phased antenna array. The fabrication of the phase shifter illustrated by 702-710 produces a phase shifter that is compact in size and limited in price.

Example Embodiments

Example 1 includes a phase shifting segment, the phase shifting segment comprising: a ferrite element configured to propagate electromagnetic energy longitudinally between a first end and a second end, wherein the ferrite element has two in-plane surfaces and two out-of-plane surfaces, wherein the in-plane surfaces are opposite one another and extend longitudinally between the first end and the second end, and the out-of-plane surfaces are opposite one another and extend longitudinally between the first end and the second end, wherein the out-of-plane surfaces are orthogonal to the in-plane surfaces; a first solid dielectric layer that abuts against one of the out-of-plane surfaces of the ferrite element; a second solid dielectric layer that abuts against one of the out-of-plane surfaces of the ferrite element, wherein the first solid dielectric layer and the second solid dielectric layer abut against different out-of-plane surfaces, wherein the first solid dielectric layer and the second solid dielectric layer have a first dielectric end that corresponds to the first end and a second dielectric end that corresponds to the second end; and a metal layer encapsulating the ferrite element, the first solid dielectric layer, and the second solid dielectric layer, wherein the metal layer is in contact with the two in-plane surfaces of the ferrite element.

Example 2 includes the phase shifting segment of Example 1, further comprising a magnetizing winding that extends between the first end and the second end in parallel with the in-plane surfaces, wherein current applied to the magnetizing winding changes the magnetization of the ferrite element.

Example 3 includes the phase shifting segment of Example 2, wherein the magnetizing winding further extends from both the first end and the second end of the ferrite element through the metal layer in parallel with the in-plane surfaces.

Example 4 includes the phase shifting segment of any of Examples 1-3, further comprising: a first mode suppressor coupled to the first end of the ferrite element; and a second mode suppressor coupled to the second end of the ferrite element, wherein the first mode suppressor and the second mode suppressor are configured to suppress the propagation of electromagnetic energy having high order modes within the ferrite element, wherein the first mode suppressor and the second mode suppressor also abut against the first solid dielectric layer and the second solid dielectric layer and are encapsulated by the metal layer.

Example 5 includes the phase shifting segment of any of Examples 1-4, further comprising: a first coupling section; and a second coupling section, wherein the first coupling section and the second coupling section are respectively connected to the first dielectric end and the second dielectric end, wherein the first coupling section and the second coupling section are configured to couple the phase shifting segment to at least one waveguide element.

Example 6 includes the phase shifting segment of Example 5, wherein the first coupling section and the second coupling section is composed of the same material as the first solid dielectric layer and the second solid dielectric layer.

Example 7 includes the phase shifting segment of any of Examples 5-6, wherein the first coupling section and the second coupling section couple the phase shifting segment to at least one double ridge waveguide.

Example 8 includes the phase shifting segment of any of Examples 5-7, wherein the metal layer encloses the surfaces of the first coupling section and the second coupling section that are not coupled to the phase shifting segment or to the at least one waveguide element.

Example 9 includes the phase shifting segment of any of Examples 5-8, wherein the waveguide element is a radiation element.

Example 10 includes the phase shifting segment of any of Examples 1-9, wherein the phase shifting segment is part of a phased antenna array.

Example 11 includes a method for fabricating a phase shifter, the method comprising: fabricating a ferrite element with a first end and a second end, wherein electromagnetic energy propagating through the ferrite element propagates between the first end and the second end; placing the ferrite element within a waveguide mold; injecting a liquefied dielectric into the waveguide mold, wherein the liquefied dielectric hardens to form a first solid dielectric layer and a second solid dielectric layer that abut against out-of-plane surfaces of the ferrite element, wherein the first solid dielectric layer and the second solid dielectric layer have a first dielectric end that corresponds to the first end and a second dielectric end that corresponds to the second end; exposing in-plane surfaces of the ferrite element, wherein the in-plane surfaces extend longitudinally between the first end and the second end and are orthogonal to the out-of-plane surfaces that extend longitudinally between the first end and the second end; masking surfaces through which electromagnetic energy is emitted into and transmitted from the phase shifter; and plating the exposed surfaces of the phase shifter.

Example 12 includes the method of Example 11, wherein the waveguide mold comprises a first coupling section mold and a second coupling section mold, wherein the injected dielectric forms: a first coupling section; and a second coupling section, wherein the first coupling section and the second coupling section are respectively connected to the first dielectric end and the second dielectric end, wherein the first coupling section and the second coupling section are configured to couple the phase shifting segment to at least one waveguide element.

Example 13 includes the method of Example 12, wherein the at least one waveguide element is a double ridge waveguide.

Example 14 includes the method of any of Examples 11-13, wherein fabricating the ferrite element further comprises: coupling a first mode suppressor to the first end; and coupling a second mode suppressor to the second end.

Example 15 includes the method of any of Examples 11-14, wherein exposing in-plane surfaces of the ferrite element comprises: removing the waveguide mold; and removing the dielectric in contact with the in-plane surfaces of the ferrite element.

Example 16 includes the method of Example 15, wherein the dielectric is removed by fly-cutting at least one in-plane surface of the phase shifter.

Example 17 includes the method of any of Examples 11-16, wherein plating the exposed surfaces of the ferrite element comprises: plating the phase shifter; and removing masks from the masked surfaces.

Example 18 includes the method of any of Examples 11-17, further comprising coupling the phase shifter to at least one waveguide element.

Example 19 includes a phased array antenna system, the system comprising: a plurality of waveguide elements configured to emit electromagnetic radiation; a plurality of phase shifters, a phase shifter in the plurality of phase shifters coupled to an associated waveguide element in the plurality of waveguide elements, wherein the phase shifter changes the phase of the electromagnetic radiation to steer an antenna beam, the phase shifter comprising: a ferrite element configured to propagate electromagnetic energy between a first end and a second end, wherein the ferrite element has two in-plane surfaces and two out-of-plane surfaces, wherein the in-plane surfaces are opposite one another and extend longitudinally between the first end and the second end, and the out-of-plane surfaces are opposite one another and extend longitudinally between the first end and the second end, wherein the out-of-plane surfaces are orthogonal to the in-plane surfaces; a first solid dielectric layer that abuts against one of the out-of-plane surfaces of the ferrite element; a second solid dielectric layer that abuts against one of the out-of-plane surfaces of the ferrite element, wherein the first solid dielectric layer and the second solid dielectric layer abut against opposite surfaces of the ferrite element; and a metal layer encapsulating the ferrite element, the first solid dielectric layer, and the second solid dielectric layer, wherein the metal layer is in contact with the two in-plane surfaces of the ferrite element; and a plurality of magnetizing windings, wherein each magnetizing winding in the plurality of magnetizing windings changes the magnetization of the ferrite element in an associated phase shifter.

Example 20 includes the phased array antenna system of Example 19, wherein the phase shifter further comprises: a first mode suppressor coupled to the first end of the ferrite element; and a second mode suppressor coupled to the second end of the ferrite element, wherein the first mode suppressor and the second mode suppressor are configured to suppress the propagation of electromagnetic energy having high order modes within the ferrite element, wherein the first mode suppressor and the second mode suppressor also abut against the first solid dielectric layer and the second solid dielectric layer and are encapsulated by the metal layer.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. A phase shifting segment, the phase shifting segment comprising:

a ferrite element configured to propagate electromagnetic energy longitudinally between a first end and a second end, wherein the ferrite element has two in-plane surfaces and two out-of-plane surfaces, wherein the in-plane surfaces are opposite one another and extend longitudinally between the first end and the second end, and the out-of-plane surfaces are opposite one another and extend longitudinally between the first end and the second end, wherein the out-of-plane surfaces are orthogonal to the in-plane surfaces;

a first solid dielectric layer that abuts against one of the out-of-plane surfaces of the ferrite element;

a second solid dielectric layer that abuts against one of the out-of-plane surfaces of the ferrite element, wherein the first solid dielectric layer and the second solid dielectric layer abut against different out-of-plane surfaces, wherein the first solid dielectric layer and the second solid dielectric layer have a first dielectric end that corresponds to the first end and a second dielectric end that corresponds to the second end;

a metal layer encapsulating the ferrite element, the first solid dielectric layer, and the second solid dielectric layer, wherein the metal layer is in contact with the two in-plane surfaces of the ferrite element;

a first coupling section; and a second coupling section, wherein the first coupling section and the second coupling section are respectively connected to the first dielectric end and the second dielectric end; and wherein the first coupling section, the second coupling section, the first solid dielectric layer, and the second dielectric layer are a contiguous piece of dielectric.

2. The phase shifting segment of claim 1, further comprising a magnetizing winding that extends between the first end and the second end in parallel with the in-plane surfaces, wherein current applied to the magnetizing winding changes the magnetization of the ferrite element.

3. The phase shifting segment of claim 2, wherein the magnetizing winding further extends from both the first end and the second end of the ferrite element through the metal layer in parallel with the in-plane surfaces.

4. The phase shifting segment of claim 1, further comprising:

a first mode suppressor coupled to the first end of the ferrite element; and a second mode suppressor coupled to the second end of the ferrite element, wherein the first mode suppressor and the second mode suppressor are configured to suppress the propagation of electromagnetic energy having high order modes within the ferrite element, wherein the first mode suppressor and the second mode suppressor also abut against the first solid dielectric layer and the second solid dielectric layer and are encapsulated by the metal layer.

5. The phase shifting segment of claim 1, wherein the first coupling section and the second coupling section are configured to couple the phase shifting segment to at least one waveguide element.

6. The phase shifting segment of claim 5, wherein the first coupling section and the second coupling section couple the phase shifting segment to at least one double ridge waveguide.

7. The phase shifting segment of claim 5, wherein the metal layer encloses the surfaces of the first coupling section and the second coupling section that are not coupled to the phase shifting segment or to the at least one waveguide element.

8. The phase shifting segment of claim 5, wherein the waveguide element is a radiation element.

9. The phase shifting segment of claim 1, wherein the phase shifting segment is part of a phased antenna array.

10. A method for fabricating a phase shifter, the method comprising:

fabricating a ferrite element with a first end and a second end, wherein electromagnetic energy propagating through the ferrite element propagates between the first end and the second end;

placing the ferrite element within a waveguide mold;

injecting a liquefied dielectric into the waveguide mold, wherein the liquefied dielectric hardens to form a first solid dielectric layer and a second solid dielectric layer that abut against out-of-plane surfaces of the ferrite element, wherein the first solid dielectric layer and the second solid dielectric layer have a first dielectric end that corresponds to the first end and a second dielectric end that corresponds to the second end, wherein the injected dielectric forms a first coupling section and a second coupling section, wherein the first coupling section and a second coupling section are respectively connected to the first dielectric end and the second dielectric end as a contiguous piece of dielectric;

exposing in-plane surfaces of the ferrite element, wherein the in-plane surfaces extend longitudinally between the first end and the second end and are orthogonal to the out-of-plane surfaces that extend longitudinally between the first end and the second end;

masking surfaces through which electromagnetic energy is emitted into and transmitted from the phase shifter; and plating the exposed surfaces of the phase shifter.

11. The method of claim 10, wherein the first coupling section and the second coupling section are configured to couple the phase shifting segment to at least one waveguide element.

12. The method of claim 11, wherein the at least one waveguide element is a double ridge waveguide.

13. The method of claim 10, wherein fabricating the ferrite element further comprises:

coupling a first mode suppressor to the first end; and coupling a second mode suppressor to the second end.

14. The method of claim 10, wherein exposing in-plane surfaces of the ferrite element comprises:

removing the waveguide mold; and removing the dielectric in contact with the in-plane surfaces of the ferrite element.

15. The method of claim 14, wherein the dielectric is removed by fly-cutting at least one in-plane surface of the phase shifter.

16. The method of claim 10, wherein plating the exposed surfaces of the ferrite element comprises:

plating the phase shifter; and removing masks from the masked surfaces.

17. The method of claim 10, further comprising coupling the phase shifter to at least one waveguide element.

18. A phased array antenna system, the system comprising:

a plurality of waveguide elements configured to emit electromagnetic radiation;

a plurality of phase shifters, a phase shifter in the plurality of phase shifters coupled to an associated waveguide element in the plurality of waveguide elements, wherein the phase shifter changes the phase of the electromagnetic radiation to steer an antenna beam, the phase shifter comprising:

a ferrite element configured to propagate electromagnetic energy between a first end and a second end, wherein the ferrite element has two in-plane surfaces and two out-of-plane surfaces, wherein the in-plane surfaces are opposite one another and extend longitudinally between the first end and the second end, and the out-of-plane surfaces are opposite one another and extend longitudinally between the first end and the second end, wherein the out-of-plane surfaces are orthogonal to the in-plane surfaces;

a first solid dielectric layer that abuts against one of the out-of-plane surfaces of the ferrite element;

a second solid dielectric layer that abuts against one of the out-of-plane surfaces of the ferrite element, wherein the first solid dielectric layer and the second solid dielectric layer abut against opposite surfaces of the ferrite element; and a metal layer encapsulating the ferrite element, the first solid dielectric layer, and the second solid dielectric layer, wherein the metal layer is in contact with the two in-plane surfaces of the ferrite element;

a first coupling section; and a second coupling section, wherein the first coupling section and the second coupling section are respectively connected to the first dielectric end and the second dielectric end; and wherein the first coupling section, the second coupling section, the first solid dielectric layer, and the second dielectric layer are a contiguous piece of dielectric.

a plurality of magnetizing windings, wherein each magnetizing winding in the plurality of magnetizing windings changes the magnetization of the ferrite element in an associated phase shifter.

19. The phased array antenna system of claim 18, wherein the phase shifter further comprises:

a first mode suppressor coupled to the first end of the ferrite element; and a second mode suppressor coupled to the second end of the ferrite element, wherein the first mode suppressor and the second mode suppressor are configured to suppress the propagation of electromagnetic energy having high order modes within the ferrite element, wherein the first mode suppressor and the second mode suppressor also abut against the first solid dielectric layer and the second solid dielectric layer and are encapsulated by the metal layer.

* * * * *